US011633327B1

(12) United States Patent
Wu et al.

(10) Patent No.: US 11,633,327 B1
(45) Date of Patent: Apr. 25, 2023

(54) FLOWER-SHAPED MASSAGER

(71) Applicant: Dongguanshi BaFen Industrial Co., Ltd., Dongguan (CN)

(72) Inventors: Yanping Wu, Dongguan (CN); Beichao Zhu, Dongguan (CN); Xiaolong Duan, Dongguan (CN)

(73) Assignee: DONGGUANSHI BAFEN INDUSTRIAL CO., LTD., Dongguan (CN)

( * ) Notice: Subject to any disclaimer, the term of this patent is extended or adjusted under 35 U.S.C. 154(b) by 0 days.

(21) Appl. No.: 17/872,011

(22) Filed: Jul. 25, 2022

(30) Foreign Application Priority Data

Jul. 5, 2022 (CN) ..... 202221708493.0

(51) Int. Cl.
*A61H 23/02* (2006.01)
*A61H 19/00* (2006.01)

(52) U.S. Cl.
CPC ... *A61H 23/0263* (2013.01); *A61H 2201/169* (2013.01); *A61H 2201/5007* (2013.01)

(58) Field of Classification Search
CPC ..... A61H 23/0263; A61H 2201/169; A61H 19/34; A61H 19/00; A61H 19/30; A61H 19/40; A61H 19/50; A61H 23/00; A61H 1/005; A61H 1/008
See application file for complete search history.

(56) References Cited

U.S. PATENT DOCUMENTS 5,085,207 A * 2/1992 Fiore ..... A61H 23/0254 601/134
5,460,597 A * 10/1995 Hopper ..... A61H 19/30 601/134
5,470,303 A * 11/1995 Leonard ..... A61H 19/34 600/38
10,123,934 B2 * 11/2018 Derwin ..... A61H 7/005
11,259,987 B1 * 3/2022 Chen ..... A61H 19/34
11,369,545 B1 * 6/2022 He ..... A61H 23/0263
11,554,073 B1 * 1/2023 Guo ..... A61H 23/0254
2004/0147858 A1 * 7/2004 Lee ..... A61H 19/44 601/101
2014/0163441 A1 * 6/2014 Chen ..... A61H 7/007 601/111
2015/0148592 A1 * 5/2015 Kanbar ..... A61H 19/34 600/38

(Continued)

*Primary Examiner* — Justine R Yu
*Assistant Examiner* — Christopher E Miller
(74) *Attorney, Agent, or Firm* — Andrew C. Cheng

(57) ABSTRACT

A flower-shaped massager includes an outer sleeve, and a lower shell and an upper shell inside. The lower shell is provided with a key switch and a circuit board. A driving mechanism electrically connected with the battery, the key switch and the circuit board is provided in the lower shell. The driving mechanism includes a motor and a swing member. An output shaft of the motor is connected with an eccentric wheel. An eccentric shaft of the eccentric wheel is connected with a connecting rod. One end of the connecting rod is connected with the swing member. The swing member is connected with a swing head inserted into a swing core. The motor is capable of driving the swing member together with swing core to swing back-and-forth under by the eccentric wheel and the connecting rod so as to realize either a massage function or a viewing function.

11 Claims, 5 Drawing Sheets

(56) References Cited

U.S. PATENT DOCUMENTS

| | | | | |
|---|---|---|---|---|
| 2015/0164738 | A1* | 6/2015 | Caropelo | A61H 19/30<br>601/46 |
| 2016/0192814 | A1* | 7/2016 | Kang | A47K 7/04<br>15/21.1 |
| 2019/0117495 | A1* | 4/2019 | Zhang | A61H 9/0057 |
| 2022/0160577 | A1* | 5/2022 | Cai | A61H 9/0057 |

* cited by examiner

FLOWER-SHAPED MASSAGER

FIELD

The present application relates to the technical field of massagers, in particular to a flower-shaped massager.

BACKGROUND

At present, massagers in the market realize massage by means of vibration. As someone needs relatively large massage amplitude, it is necessary to design a massager swinging back and forth. A Chinese present application patent No. 204890546U discloses a massager which uses an eccentric shaft directly connected with a driving mechanism. However, the eccentric shaft is easy to break in such a product, and it is relatively large in sound because the eccentric shaft directly strikes upper and lower inner walls of a cavity to swing during rotation. Therefore, it is desired to design an improved massager which can overcome the above shortcoming.

SUMMARY

In order to overcome defects in the prior art, the present invention provides a flower-shaped massager which has a long service life.

In one aspect, the present invention provides a flower-shaped massager which comprises an outer sleeve with a swing core, a lower shell and an upper shell disposed inside the outer sleeve. A key switch and a circuit board are mounted to an inside of the lower shell; the circuit board is connected with a battery and a charging needle; and the lower shell is internally provided with a driving mechanism electrically connected with the battery, the key switch and the circuit board. the driving mechanism comprises a motor and a swing member, an output shaft of the motor is connected with an eccentric wheel with an eccentric shaft; the eccentric shaft of the eccentric wheel is connected with a connecting rod; an end of the connecting rod is pivotally connected with the swing member; and the swing member is connected with a swing head which is inserted into the swing core.

In some embodiments, the lower shell is provided with a column, a through hole is defined in a middle part of the swing member, and the column passes through the through hole to be fixed to the upper shell such that the motor is capable of driving the swing member to swing back-and-forth around the column under cooperation of the eccentric wheel and the connecting rod.

In some embodiments, the swing member is L-shaped and comprises a first swing pivotally connected to the connecting rod and a second swing connected to the swing head, the first swing and the second swing respectively extending from the middle part with an angle formed between the first swing and the second swing.

In some embodiments, the column comprises a lower end with a larger diameter extending from the lower shell and an upper end with a smaller diameter extending from the lower end, a step is formed between the upper end and the lower end, the upper end is inserted into the through hole of the cylindrical joint of the swing member to be inserted into a hole of a hollow post of the upper shell, and the cylindrical joint of the swing member is sandwiched between the step and an end surface of the hollow post.

In some embodiments, the angle is less than 120 degrees and greater than 80 degrees.

In some embodiments, the angle is less than 100 degrees and greater than 85 degrees.

In some embodiments, the outer sleeve is made from a silica gel material and is provided with an interior cavity for accommodating the lower shell and the upper shell.

In some embodiments, an outer surface of the outer sleeve is provided with ribs at a location corresponding to the key switch.

In some embodiments, the swing core is arranged in a middle of one side of the outer sleeve, the swing core is provided with an interior space for accommodating the swing head, and the swing head swings back and forth so as to drive the swing core to move back and forth.

In some embodiments, the lower shell and the upper shell are fixed together, one side of each of the lower shell and the upper shell is provided with locking grooves/openings, a tail cover is arranged between the outer sleeve and the lower shell and between the outer sleeve and the upper shell, barbed insertion pieces are arranged on an inner side of the tail cover, and the barbed insertion pieces are engaged in corresponding locking grooves/openings to thereby secure the tail cover to the lower shell and the upper shell.

In some embodiments, an opposite end of the connecting rod is pivotally connected with the eccentric shaft, and the connecting rod is movable in a plane perpendicular to the output shaft of the motor.

The present application has the beneficial effects:

The present application provides a flower-shaped massager. Compared with the prior art, the present application has the following beneficial effects: in the product, two ends of the connecting rod are movably connected with the eccentric wheel and the swing member, respectively. A through hole is formed in the joint part of the swing member and the column is moveably received in the through hole such that the eccentric wheel is capable of driving the connecting rod to drive the swing member together with the swing head to swing around the column up and down or back and forth. The swing head is connected with a swing core to thereby drive the swing core to move up and down and/or back and forth so as to realize either a massage function or a viewing function. Such a product is relatively small in noise during work, and furthermore, the service life of the product is also relatively long.

Figure 1:
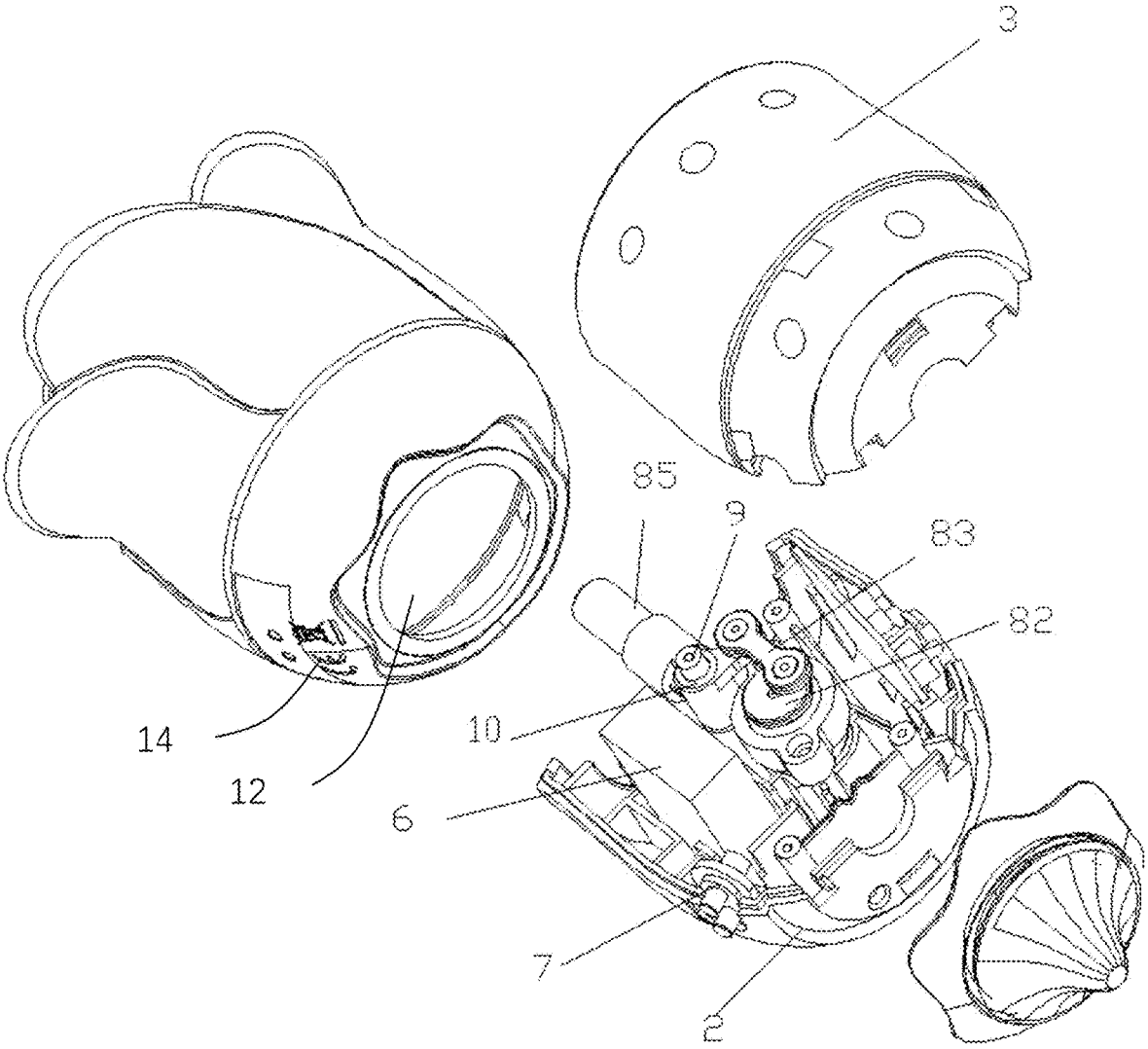
FIG. 1 is a schematic structure diagram of a flower-shaped massager according to an embodiment of the present application.

In the drawings: 1—silica gel outer sleeve; 2—lower shell; 3—upper shell; 4—key switch; 5—circuit board; 6—battery; 7—charging needle; 8—driving mechanism; 81—motor; 82—eccentric shaft; 83—connecting rod; 84—swing member; 85—swing head; 9—column; 10—through hole; 11—swing core; 12—tail cover.

DESCRIPTION OF THE EMBODIMENTS

Clear and intact description will be made on technical scheme in the embodiment of the present application below in combination with drawings in the embodiment of the present application. The described embodiments are merely a part of embodiments of the present application and are not all the embodiments. On a basis of the embodiments in the present application, all other embodiments obtained by those skilled in the technical field without creative efforts fall into the scope of protection of the present application.

FIG. 1 to FIG. 7 show a flower-shaped massager in accordance with an embodiment of the present invention. The flower-shaped massager includes an outer sleeve 1, and a lower shell 2 and an upper shell 3 located inside of the outer sleeve 1. A key switch 4 and a circuit board 5 is provided inside of the lower shell 2; the circuit board 5 is electrically connected with a battery 6 and a charging needle 7. A driving mechanism 8 is provided inside of the lower shell 2 and electrically connected with the battery 6, the key switch 4 and the circuit board 5.

The driving mechanism 8 includes a motor 81 electrically connected with the circuit board 5 and a swing member 84 driven by the motor 81. The battery 6 and the circuit board 5 are disposed at opposite sides of the motor 81. An output shaft 816 of the motor 81 is connected with an eccentric wheel 82; an eccentric shaft 822 of the eccentric wheel 82 is connected with an end of a connecting rod 83; the opposite end of the connecting rod 83 is connected with the swing member 84; and the swing member 84 is connected with a swing head 85. The lower shell 2 is further provided with a column 9 inside thereof. A through hole 10 is formed in the joint 842 of the swing member 84, and the column 9 is configured to penetrate through the through hole 10 to be inserted into a hole 342 of a hollow post 34 of the upper shell 3 (see FIG. 7). Specifically, the upper end of the column 9 is relatively small while the lower end thereof is relatively big. A step 94 is formed between the small upper end and the big lower end. The upper end of the column 9 extends through the through hole 10 to be inserted into the hole 342 of the post 34 of the upper shell 3. The joint 842 of the swing member 84 is sandwiched between the step 94 and the end surface of the post 34. The swing member 84 is L-shaped and comprises a first swing 844 connected to the opposite end of the connecting rod 83 and a second swing 846 connected to the swing head 85. The through hole 10 passes through the joint 842 which is formed between the first swing 844 and the second swing 846. Specifically, the first swing 844 and the second swing 846 respectively extend from the joint 842 with an angle formed between the first swing and the second swing. The second swing 846 comprises a connecting part 8462 connected with the joint 842 and a driving part 8464 defining a locating hole therein. The connecting part 8462 has a crossing shape. The driving part 8464 is cylindrical. The swing head 85 is cylindrical and fixed in the cylindrical hole of the driving part 8464.

In operation, the eccentric wheel 82 rotates to drive the connecting rod 83 to move back and forth, thereby driving the swing member 84 together with the swing head 85 to swing around the column 9 back and forth.

The outer sleeve 1 comprises a swing core 11 and a plurality of petal around the swing core 11. The outer sleeve 1 is made from a silica gel material and is provided with an interior cavity for accommodating the lower shell 2 and the upper shell 3. An outer surface of the outer sleeve 1 is provided with ribs 14 corresponding to the key switch 4. A swing core 11 is arranged in the middle of one side of the outer sleeve 1, the swing core 11 is internally provided with a cavity for accommodating the swing head 85, and the swing head 85 swings back and forth so as to drive the swing core 11 to move back and forth. The lower shell 2 and the upper shell 3 can be fixed together through interlocking means or fasteners such as screws. One side of each of the lower shell 2 and the upper shell 3 away from the swing core 11 is provided with locking grooves/openings 32. A tail cover 12 is arranged between the outer sleeve 1 and the lower shell 2 and between the outer sleeve 1 and the upper shell 3. Barbed insertion pieces 122 are arranged on an inner side of the tail cover 12 and are configured to engage with the corresponding locking grooves 32 of the lower shell 2 and the upper shell 3 to thereby fix the tail cover 12 to the lower and upper shells 2/3.

Figure 2:
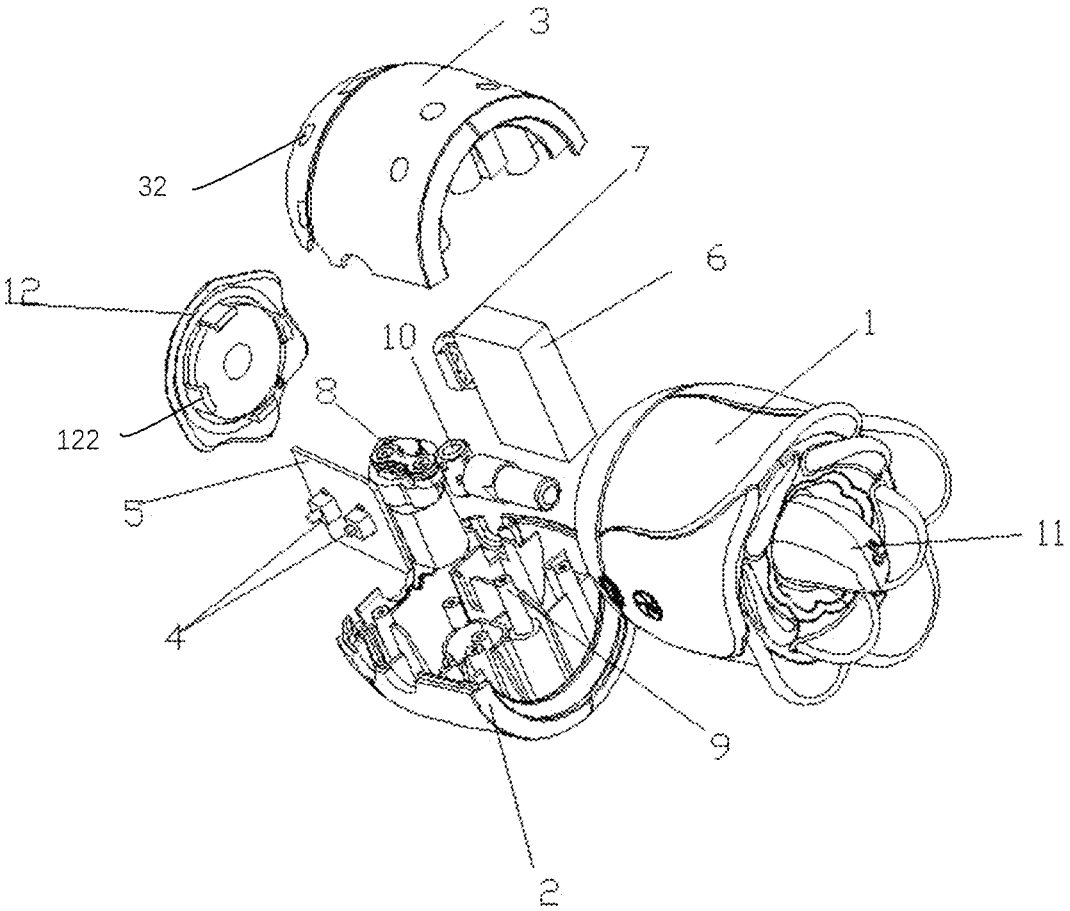
FIG. 2 is an explosive view of the flower-shaped massager.
Figure 3:
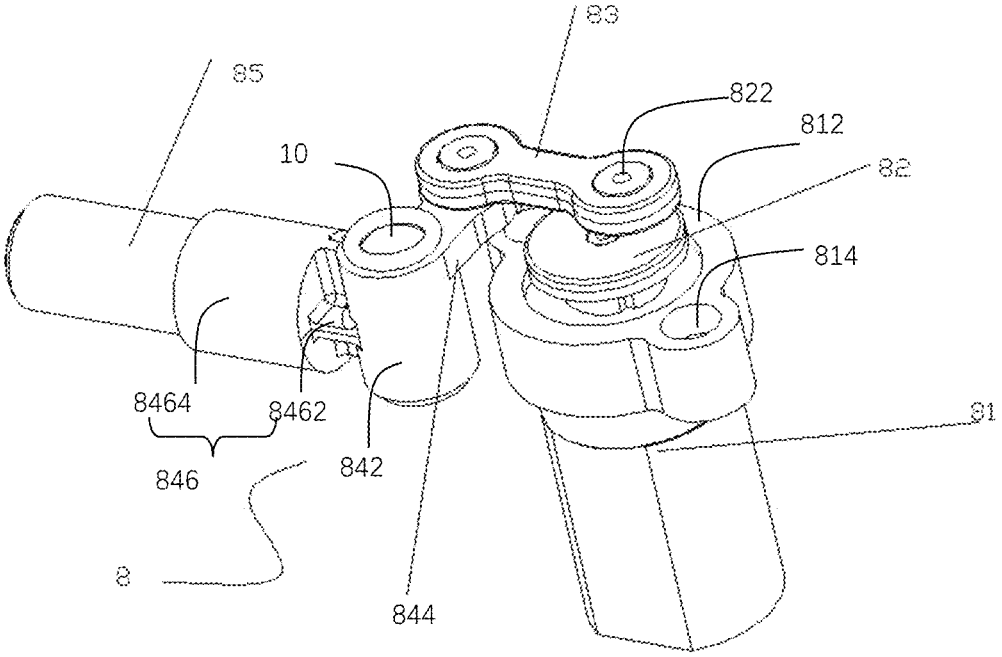
FIG. 3 illustrates a driving mechanism of the flower-shaped massager.
Figure 4:
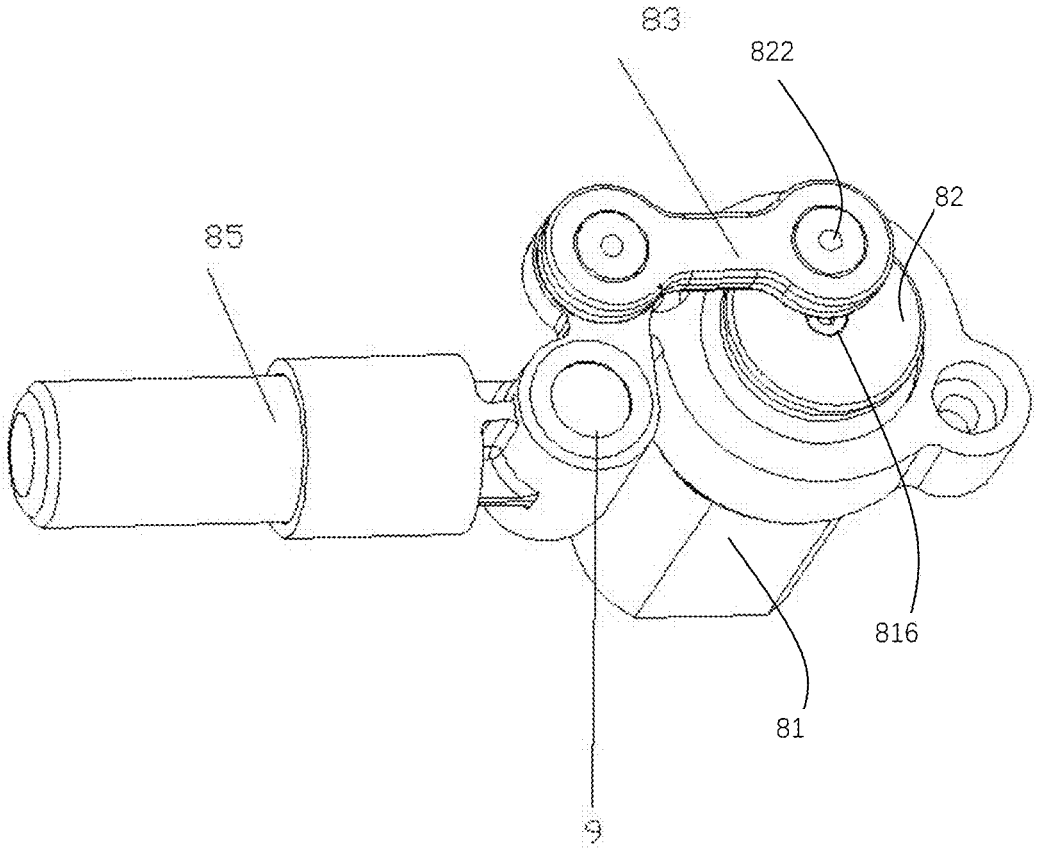
FIG. 4 is a top view of the driving mechanism.
Figure 5:
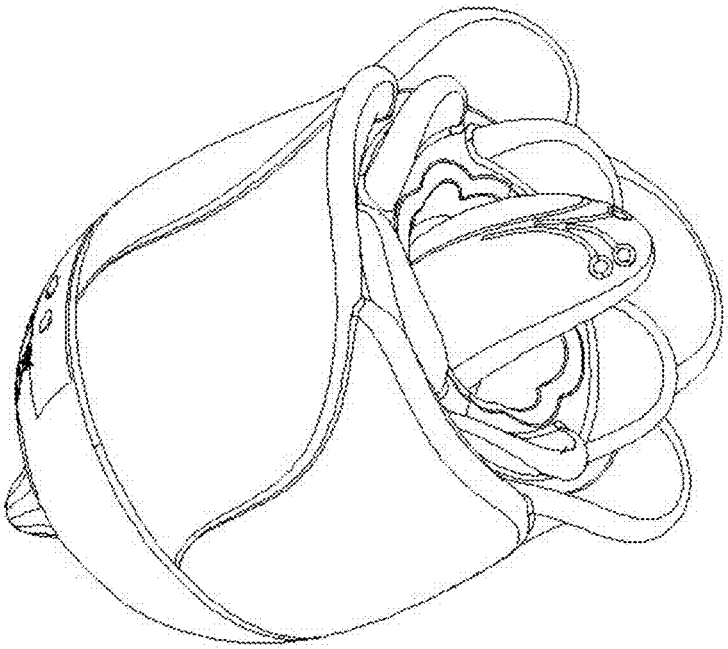
FIG. 5 is an overall schematic diagram of the flower-shaped massager of the present application.
Figure 6:
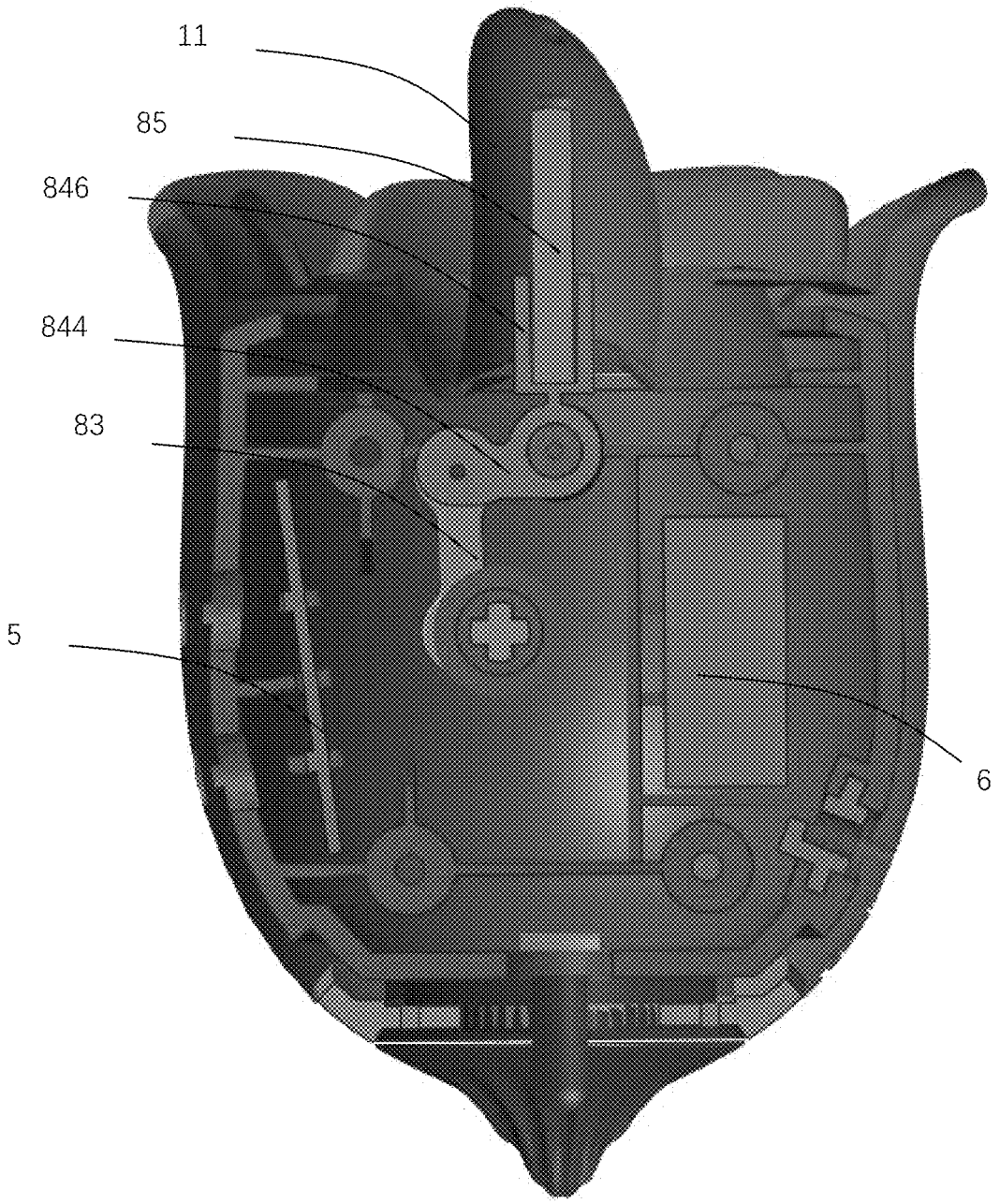
FIG. 6 is a section view of the flower-shaped massager.
Figure 7:
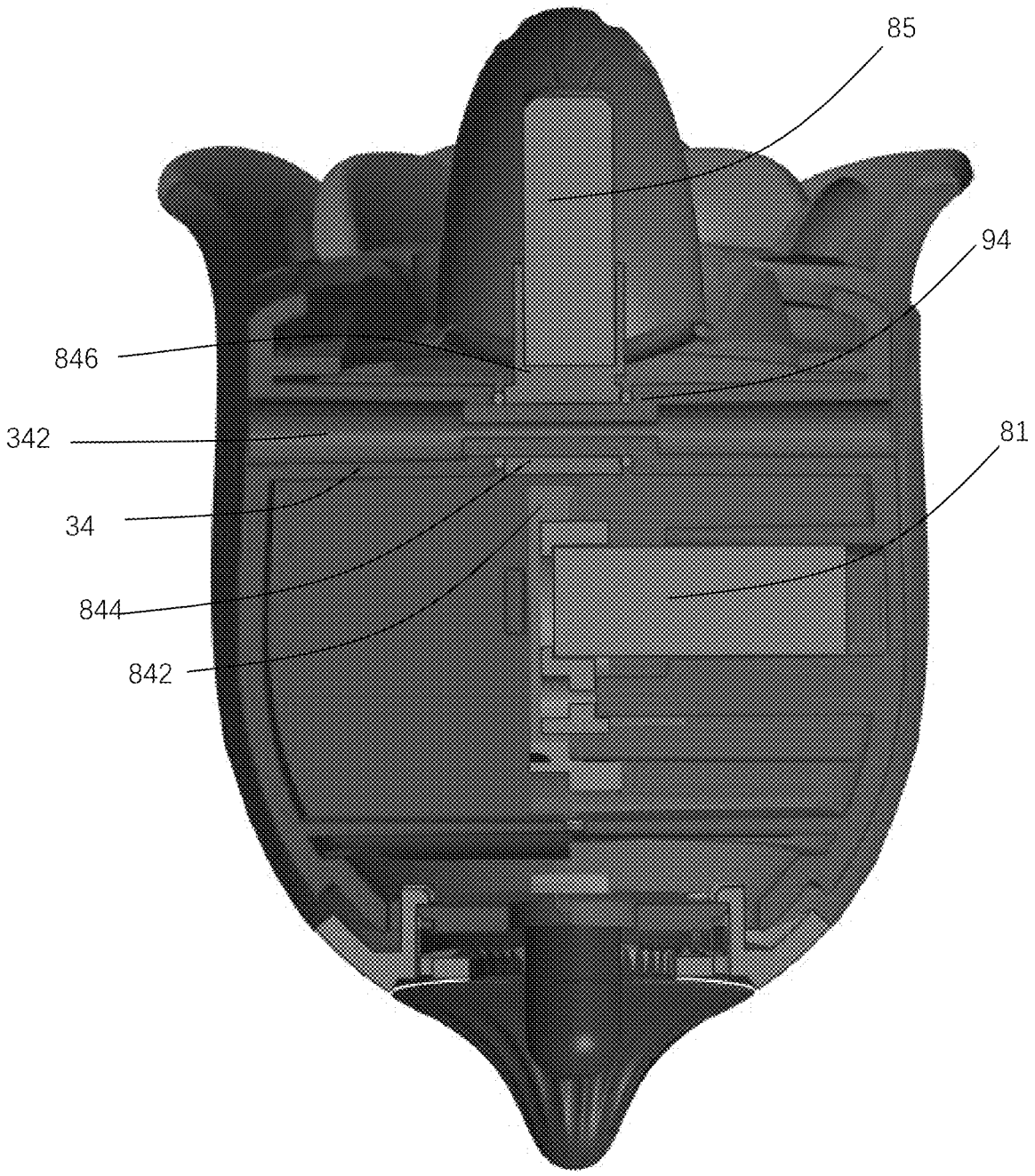
FIG. 7 is another section view of the flower-shaped massager.

Referring to FIG. 2, the lower shell 2 is internally provided with a receiving space for accommodating and fixing the motor 81 therein, such that the motor 81 can be better fixed. An upper part of the motor 81 is provided with an end cap 812. Two ends of the end cap 812 are provided with through holes 814 corresponding to threaded holes defined in protruding columns 92, such that the motor 81 can be fixed to the lower shell 2 through screws which pass through the through holes 814 to be engaged in the threaded holes defined in protruding columns 92.

A working principle is described as follows:

During use, the lower shell 2, the upper shell 3 and the driving mechanism 8 inside are assembled first and then inserted into the outer sleeve 1 via an opening 12 thereof. The outer sleeve 1 is made from the silica gel material. Therefore, the opening 12 of the outer sleeve 1 can be expanded greatly during the process of the assembled lower shell 2, upper shell 3 and driving mechanism 8 being inserted into the outer sleeve 1. After the massager is assembled completely, the battery is charged, a switch of a power supply is pressed to start the power supply, then the motor 81 is started and controlled to work by another switch. The output shaft of the motor 81 is connected with the eccentric wheel 82. Specifically, the eccentric wheel 82 defines a square hole and the output shaft is inserted into the square hole, such that the eccentric wheel 82 can be better driven and does not slip relative to the output shaft. Two ends of the connecting rod 83 are movably connected with the eccentric wheel 82 and the swing member 84, respectively. Pulled/pushed by the connecting rod 83, the swing member 84 moves back and forth. The through hole 10 is formed in the cylindrical middle part 842 of the swing member 84 (i.e., the joint of the first swing 844 and the second swing 846) and the upper end of the column 9 is moveably received in the through hole 10, such that the swing head 85 can be driven to swing back and forth around the upper end of the column 9. The end of the swing head 85 away from the swing member 84 is connected with the swing core 11 to thereby drive the swing core 11 to move up and down and back and forth so as to realize either a massage function or a viewing function.

It is to be noted that the relationship terms herein such as first and second are merely used for differentiating one body or operation from another body or operation rather than requiring or hinting any actual relationship or sequence among the bodies or operations. Further, the terms "include", "comprise" or any other variants are intended to cover non-excludable inclusions, such that a process, method, article or apparatus including a series of elements not only include these elements, but also further include other elements which are not listed obviously or further include inhered elements of the process, method, article or apparatus.

Although the embodiments of the present application have been shown and described, those of ordinary skill in the art can understand that various changes, modifications, substitutions, and alterations could be made hereto without departing from the principle and spirit of the present application. The scope of the present application is limited by the claims and the equivalents hereof.

What is claimed is:

1. A flower-shaped massager, comprising:

an outer sleeve (1) with a swing core (11);

a lower shell (2) and an upper shell (3) disposed inside the outer sleeve (1), wherein a key switch (4) and a circuit board (5) are mounted to an inside of the lower shell (2); the circuit board (5) is connected with a battery (6) and a charging needle (7); and the lower shell (2) is internally provided with a driving mechanism (8) electrically connected with the battery (6), the key switch (4) and the circuit board (5);

wherein the driving mechanism (8) comprises a motor (81) and a swing member (84);

an output shaft of the motor (81) is connected with an eccentric wheel (82) with an eccentric shaft (822);

the eccentric shaft of the eccentric wheel (82) is connected with a connecting rod (83);

an end of the connecting rod (83) is pivotally connected with the swing member (84); and the swing member (84) is connected with a swing head (85) which is inserted into the swing core (11), wherein the lower shell (2) is provided with a column (9), a through hole (10) is defined in the swing member (84), and the column (9) passes through the through hole (10) to be fixed to the upper shell (3) such that the motor is capable of driving the swing member (84) to swing back-and-forth around the column under cooperation of the eccentric wheel (82) and the connecting rod (83); and the swing member (84) is L-shaped and comprises a cylindrical joint (842) through which the through hole (10) is defined, a first swing (844) pivotally connected to the connecting rod (83), a second swing (846) connected to the swing head (85), the first swing and the second swing respectively extending from the joint with an angle formed between the first swing and the second swing.

2. The flower-shaped massager according to claim 1, wherein the column (9) comprises a lower end with a larger diameter extending from the lower shell and an upper end with a smaller diameter extending from the lower end, a step (94) is formed between the upper end and the lower end, the upper end is inserted into the through hole (10) of the cylindrical joint of the swing member (84) to be inserted into a hole (342) of a hollow post (34) of the upper shell (3), and the cylindrical joint (844) of the swing member is sandwiched between the step (94) and an end surface of the hollow post (34).

3. The flower-shaped massager according to claim 2, wherein the second swing comprises a connecting part with a crossing shape and a driving part defining a cylindrical hole in which an end of the swing head is fixed, the connecting part being connected with an outer surface of the cylindrical joint.

4. The flower-shaped massager according to claim 2, wherein the angle is less than 120 degrees and greater than 80 degrees.

5. The flower-shaped massager according to claim 4, wherein the angle is less than 100 degrees and greater than 85 degrees.

6. The flower-shaped massager according to claim 1, wherein the outer sleeve (1) is made from a silica gel material and is provided with an interior cavity for accommodating the lower shell (2) and the upper shell (3).

7. The flower-shaped massager according to claim 6, wherein an outer surface of the outer sleeve (1) is provided with ribs at a location corresponding to the key switch (4).

8. The flower-shaped massager according to claim 6, wherein the swing core (11) is arranged in a middle of a side of the outer sleeve (1), the swing core (11) is provided with an interior space for accommodating the swing head (85), and the swing head (85) swings back and forth so as to drive the swing core (11) to move back and forth.

9. The flower-shaped massager according to claim 1, wherein the lower shell (2) and the upper shell (3) are fixed together, an end of each of the lower shell (2) and the upper shell (3) is provided with locking grooves/openings (32), a tail cover (12) is arranged between the outer sleeve (1) and the lower shell (2) and between the outer sleeve and the upper shell (3), barbed insertion pieces are arranged on an inner side of the tail cover (12), and the barbed insertion pieces are engaged in corresponding locking grooves/openings (32) to thereby secure the tail cover to the lower shell (2) and the upper shell (3).

10. The flower-shaped massager according to claim 1, wherein an opposite end of the connecting rod (83) opposite to the end pivotally connected with the swing member (84) is pivotally connected with the eccentric shaft (822), and the connecting rod is movable in a plane perpendicular to the output shaft (816) of the motor (81).

11. The flower-shaped massager according to claim 1, wherein the battery and the circuit board are disposed on opposite sides of the motor.

* * * * *